US005797811A

United States Patent [19]

Vestal

[11] Patent Number: 5,797,811

[45] Date of Patent: Aug. 25, 1998

[54] END PIECE WITH SYMMETRICAL AIR FOIL SIDE WINGS FOR A JUGGLING STICK

[76] Inventor: William E. Vestal, Lot 8, Block 19, #8 Carbonate Ave., Crestone, Colo. 81131

[21] Appl. No.: 795,149

[22] Filed: Feb. 7, 1997

[51] Int. Cl.[6] ..... A63B 67/00

[52] U.S. Cl. ..... 473/514; 473/613; 473/578; 473/586; 446/217; 446/488

[58] Field of Search ..... 473/514, 569, 473/596, 613, 614, 578, 579, 580, 581, 585, 586; 482/109; 446/488, 217

[56] References Cited

U.S. PATENT DOCUMENTS

| | | | |
|---|---|---|---|
| D. 360,453 | 7/1995 | Poreda . | |
| 688,599 | 12/1901 | Creelman . | |
| 708,313 | 9/1902 | Buck . | |
| 1,385,642 | 7/1921 | Restein . | |
| 2,302,845 | 11/1942 | Emerson | 473/580 |
| 3,010,721 | 11/1961 | Ellman . | |
| 4,758,197 | 7/1988 | Lee | 446/217 |
| 4,767,373 | 8/1988 | Antonio | 446/488 |
| 4,796,883 | 1/1989 | Ratner . | |
| 4,895,377 | 1/1990 | Arbor | 473/514 |
| 5,163,879 | 11/1992 | Black . | |
| 5,590,884 | 1/1997 | Goldberg | 473/514 |

*Primary Examiner*—William M. Pierce
*Attorney, Agent, or Firm*—Hugh D. Jaeger

[57] ABSTRACT

A juggling stick including on each end an end piece with symmetrical air foil side wings of a closed cell foam or like material, such as leather, layered fabrics or inflatable rubber and rubber-like materials. The closed cell foam is intended to be mounted with grommets or other fastening device and secured to each end of the juggling stick. The closed cell foam can be coated with a liquid plastic and even splatter coated, all of non-toxic material. Each end piece includes at least three symmetrical air foil side wings with locking tabs to engage through a hole of the next air foil side wing. The air foils cut through the air with the wings catching the air and slowing the action or play of the juggling stick down for complex moves, even to the point of causing a slower negative flowtation for a change of direction depending upon the particular juggling maneuvers. Tassels can be applied to each end of the juggling stick for artistic decoration.

3 Claims, 5 Drawing Sheets

END PIECE WITH SYMMETRICAL AIR FOIL SIDE WINGS FOR A JUGGLING STICK

CROSS REFERENCES TO CO-PENDING APPLICATIONS

None.

BACKGROUND OF THE INVENTION

1. Field of the Invention

The present invention is for a juggling stick, and more particularly, pertains to opposing end pieces with symmetrical air foil side wings for the juggling stick.

2. Description of the Prior Art

Prior art juggling sticks have had end pieces which have required time consuming construction, as well as sometimes not being aerodynamically balanced with respect to the sides of the end piece and with respect to the other end piece. The repeatability of the aerodynamics of the end pieces were very difficult to control.

The present invention overcomes the disadvantages of the prior art by providing end pieces which are aerodynamically balanced with respect to itself and with respect to other end pieces, and minimizes labor during assembly and installation.

SUMMARY OF THE INVENTION

The general purpose of the present invention is an end piece with symmetrical air foil side wings for a juggling stick which are used on opposing ends of a juggling stick for creating a juggling stick which cuts through the air, causes a negative flowtation for a change of direction during complex moves, and catches the air.

According to one embodiment of the present invention, there is provided an end piece with symmetrical air foil side wings for a juggling stick, including a plurality of symmetrical air foil side wings about a central hole of a member of closed cell foam or like material. Each air foil side wing is symmetrical with respect to each other and includes a locking tab and a hole for locking with the adjacent air foil side wings. The closed cell foam can be coated and then splatter coated with a liquid plastic, all of which is non-toxic. The stick itself can include ribbed rubber over a polymer or polymer with reenforcing strands, such as fiberglass.

According to an alternate embodiment, there is provided a symmetric end piece which is compact and readily assembled.

One significant aspect and feature of the present invention include an end piece with symmetrical air foil side wings of a closed cell foam or like material, and which provides an aerodynamic structure, especially for complex juggling maneuvers.

Another significant aspect and feature of the present invention is ease of assembly where the end pieces can be flat packaged and then assembled to final air foil shape form by insertion of locking tabs into the next successive hole in the next symmetrical air foil side wing.

A further significant aspect and feature of the present invention is the use of air foils to slow the action or play of the juggling stick.

An additional significant aspect and feature of the present invention is an end piece constructed as a one piece unit.

Another significant aspect and feature of the present invention is an end piece which is assembled to provide an aerodynamic structure or as a compact unit having a lesser profile.

Having thus described embodiments of the present invention, it is one embodiment of the present invention to provide a juggling stick with symmetrical air foil side wing end pieces having like aerodynamic structures.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
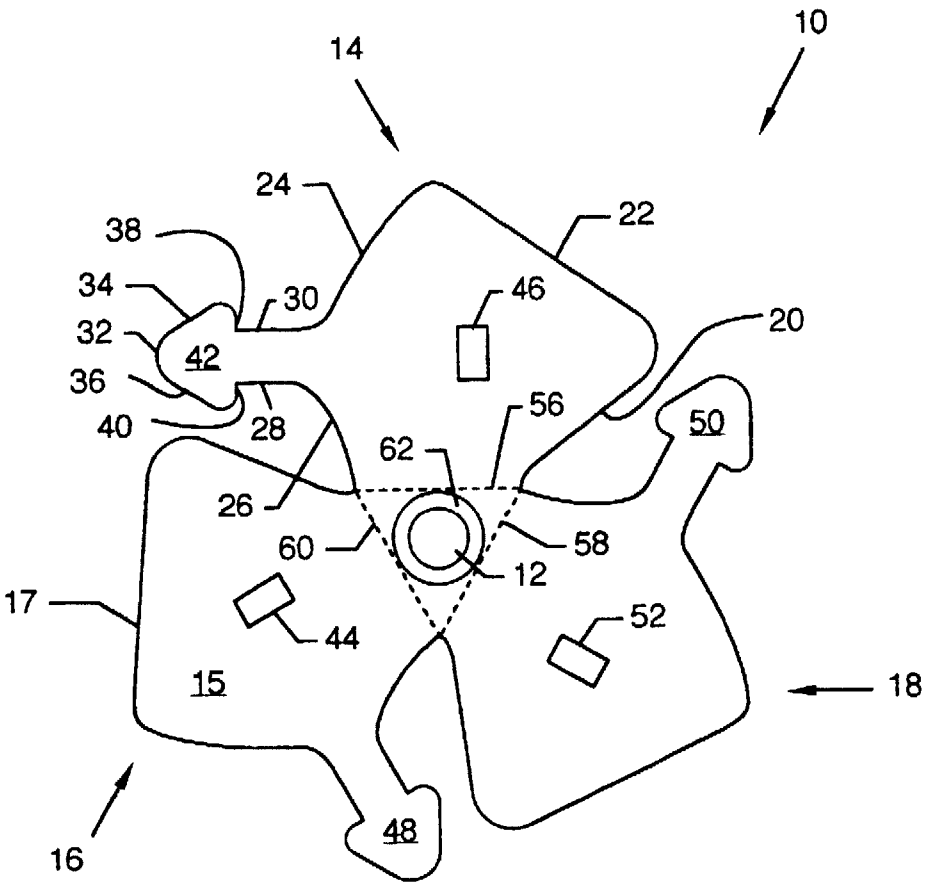
FIG. 1 illustrates a perspective view of a juggling stick incorporating the use of opposing air foil symmetrical side wings.
Figure 2:
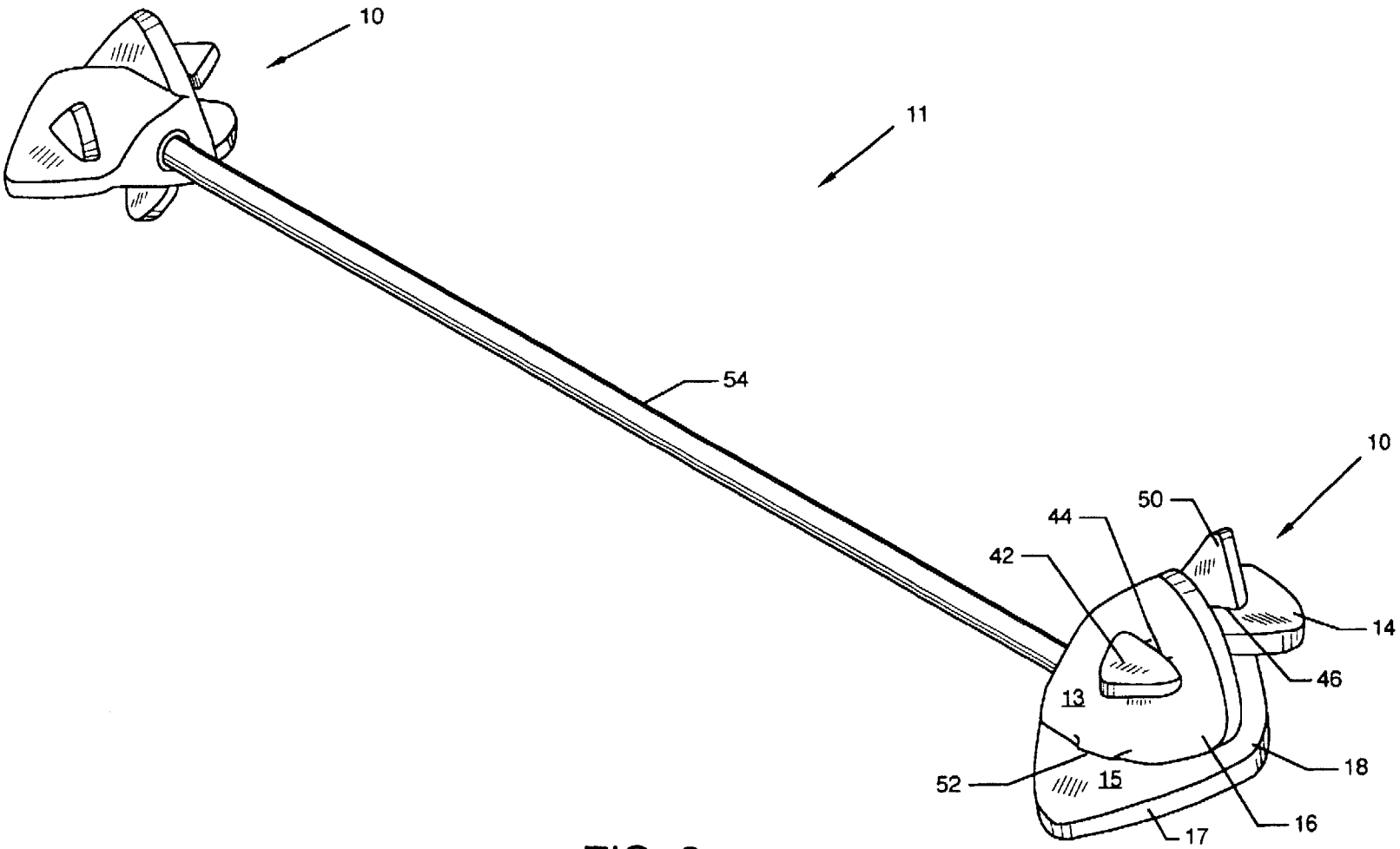
FIG. 2 illustrates an unassembled planar view of the air foil symmetrical side wings.

FIG. 1 illustrates a planar and unassembled end piece 10 with symmetrical air foil side wings for a juggling stick 11, illustrated in FIG. 2, the present invention, and includes a central hole 12 and air foil symmetrical side wings 14, 16 and 18. The end piece includes a backside surface 13 which orients and faces a juggling stick shaft 54 and a frontside surface 15 which orients away from the juggling stick shaft 54 which is illustrated in FIG. 2. A continuous edge 17, which is common to other members described herein, aligns between backside and frontside surfaces 13 and 15. Each of the air foil symmetrical side wings 14, 16 and 18 are identical with respect to each other about the central hole 12, and three air foil symmetrical side wings, as by way of example and for purposes of illustration only, are not to be construed as limiting of the present invention. One of the air foil symmetrical side wings 14, aligned between surfaces 13 and 15, is now described in detail and includes sides 20, 22, 24 and 26, extending members 28 and 30, a tip 32 about sides 34 and 36, and members 38 and 40. Members 28–40 form a locking tab 42 which engages a hole 44 of the next adjacent air foil symmetrical side wing 16. The hole 46 on wing 14 is for accommodation of the preceding locking tab 50 of the air foil symmetrical side wing 18. The other two air foil symmetrical side wings 16 and 18, including locking tabs 48–50 and holes 44 and 52, are identical to air foil symmetrical side wing 14, and for purposes of brevity, are identical in structure and Mode of Operation as later described in detail. Holes 44, 46 and 52 align between backside and frontside surfaces 13 and 15. Imaginary fold lines 56, 58 and 60 are located about the central hole 12 and the junction of air foil symmetrical side wings 14, 18 and 16, respectively, as illustrated. A grommet 62 with a predetermined geometrical configuration engages the hole 12 and secures the end piece 10 to the juggling stick shaft 54, illustrated in FIG. 2.

FIG. 2 illustrates a perspective view of opposing end pieces 10 secured to the shaft 54 of a juggling stick 11, where all numerals correspond to those elements previously described.

Figure 3:
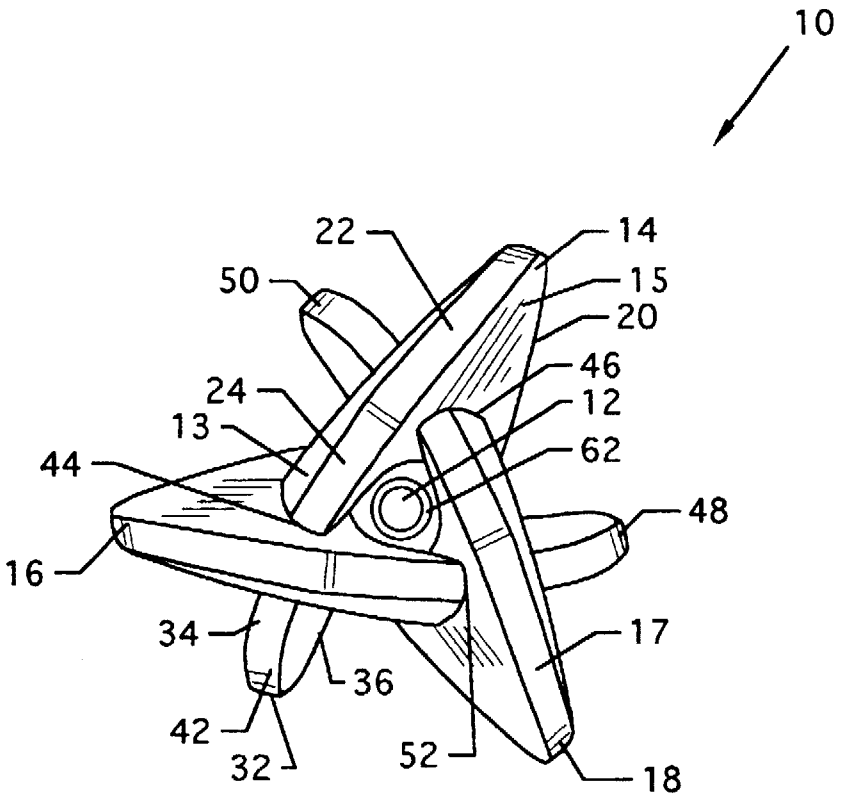
FIG. 3 illustrates an end view of the air foil symmetrical side wings.

FIG. 3 illustrates an end view of an end piece 10 in the desired configuration where the end tabs 42, 48 and 50 have engaged the appropriate holes 44, 52 and 46 starting penetration at surface 15 and extending through surface 13 of the next air foil symmetrical side wing 16, 18 and 14.

MODE OF OPERATION

FIG. 1, in conjunction with FIG. 3, best illustrates the mode of operation and assembly of the end piece 10, as illustrated in FIG. 2. Final folded formation of the planar end piece 10 of FIG. 1 is accomplished by folding of the air foil symmetrical side wing 14 along the imaginary fold line 56 and folding of the air foil symmetrical side wing 16 along imaginary fold line 16 toward the viewer. Subsequent to sufficient folding, locking tab 42 of the air foil symmetrical side wing 14 is inserted through surface 15 in locking engagement with hole 44 in the air foil symmetrical side wing 16. Members 28 and 30 of the locking tab 42 extend through the hole 44 and members 38 and 40 of the locking tab 42 engage surface 13 to provide for securement of the air foil symmetrical side wing 14 to the air foil symmetrical side wing 16. Securement of air foil symmetrical side wing 16 to air foil symmetrical side wing 18 and securement of air foil symmetrical side wing 18 to air foil symmetrical side wing 14 is accomplished in a similar fashion where tab 48 engages the next hole 52 and tab 50 engages the next hole 46 to provide a mutually secured end piece 10.

Figure 4:
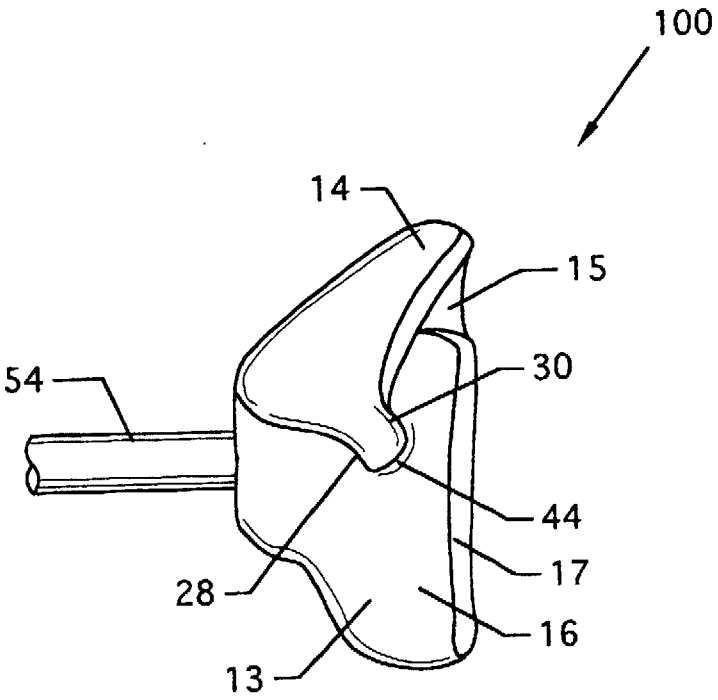
FIG. 4, an alternative embodiment, illustrates a side view of the flat planar end piece member of FIG. 2 assembled to provide an end piece having a lesser profile and less aerodynamic drag; and, FIG. 5 illustrates an end view of the assembled end piece member of FIG. 4.

FIG. 4, an alternative embodiment, illustrates a side view of the planar end piece 10 of FIG. 1 assembled to produce an end piece 100 having a more compact shape somewhat resembling the shape of a tulip.

Figure 5:
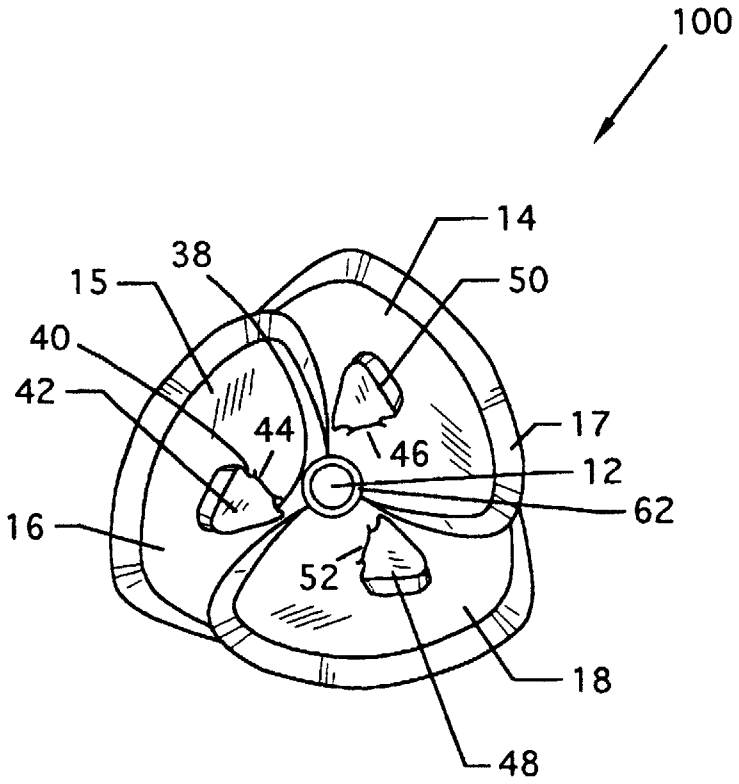

FIG. 5 illustrates an end view of the end piece 100 of FIG. 4 in conjunction with FIGS. 4 and 5, and best illustrates the mode of operation and assembly of the end piece 100, as illustrated in FIGS. 4 and 5. Final folded formation of the planar end piece 10 of FIG. 1 to form an end piece 100 in a compact shape is accomplished by folding of the air foil symmetrical side wing 14 along the imaginary fold line 56 and folding of the air foil symmetrical side wing 16 along imaginary fold line 16 toward the viewer. Subsequent to sufficient folding, locking tab 42 of the air foil symmetrical side wing 14 is inserted through the backside surface 13 in locking engagement with hole 44 in the air foil symmetrical side wing 16. Members 28 and 30 of the locking tab 42 extend through the hole 44 and members 38 and 40 engage frontside surface 15 to provide for securement of the air foil symmetrical side wing 14 to the air foil symmetrical side wing 16. Securement of air foil symmetrical side wing 16 to air foil symmetrical side wing 18 and securement of air foil symmetrical side wing 18 to air foil symmetrical side wing 14 is accomplished in a similar fashion where tab 48 engages the next hole 52 and tab 50 engages the next hole 46 to provide a mutually secured end piece 10.

Various modifications can be made to the present invention without departing from the apparent scope hereof.

I claim:

1. An end piece for a juggling stick comprising:

a. a member with symmetrical air foil side wings about a central hole, each side wing including a locking tab and a central hole, the locking tab engages into the central hole of the adjacent air foil side wing, thereby forming an aerodynamically stable end piece.

2. A juggling stick, including a symmetrically air foil side wing end piece, each end piece including:

a. a member with symmetrical air foil side wings about a central hole, each side wing including a locking tab and a central hole, the locking tab engages into the central hole of the adjacent air foil side wing, thereby forming an aerodynamically stable end piece.

3. A juggling stick comprising:

a. a stick; and, b. an end piece secured on each end of said stick, said end piece comprising an air foil symmetrical side wing including a central hole, three outwardly oriented surfaces with a locking tab means, and a hole means in each of said surfaces, wherein said locking tab means engages into said hole means, thereby forming said wing.

* * * * *